US005526721A

United States Patent [19]

Waisvisz

[11] Patent Number: 5,526,721

[45] Date of Patent: Jun. 18, 1996

[54] TOOL HAVING SWITCHABLE PIN-SHAPED TOOL ELEMENTS

[76] Inventor: Eduard A. Waisvisz, Lievensbergstraat 1, 1333 ZR Almere, Netherlands

[21] Appl. No.: 321,139

[22] Filed: Oct. 11, 1994

[51] Int. Cl.[6] ..... B25B 23/00

[52] U.S. Cl. ..... 81/440; 81/439

[58] Field of Search ..... 81/437, 439, 440

[56] References Cited

U.S. PATENT DOCUMENTS

| | | | |
|---|---|---|---|
| 1,501,222 | 7/1924 | Lamp | 81/439 |
| 2,242,873 | 5/1941 | Thompson . | |
| 2,749,953 | 6/1956 | Rundle . | |
| 2,765,013 | 10/1956 | Pedersen . | |
| 3,006,395 | 10/1961 | Dye . | |
| 3,194,286 | 7/1965 | Wagner . | |
| 3,750,729 | 8/1973 | Lemieux . | |
| 4,463,788 | 8/1984 | Corona et al. . | |

FOREIGN PATENT DOCUMENTS

| | | |
|---|---|---|
| 951860 | 11/1956 | Germany . |
| 8103593 | 2/1983 | Netherlands . |
| 163627 | 4/1934 | Switzerland . |

*Primary Examiner*—Bruce M. Kisliuk
*Assistant Examiner*—Joni B. Danganan
*Attorney, Agent, or Firm*—Westman, Champlin & Kelly

[57] ABSTRACT

A tool having a plurality of changeable pin-shaped tool elements comprises a substantially cylindrical housing having a cavity therein opening to the outside through a passage opening lying substantially on the axis of the housing. This cavity contains a plurality of tool elements spaced regularly about the circumference of the housing and lying outside the axis of the housing in their rest positions, the tool elements each comprising actuating means projecting outwardly of the housing and being movable in longitudinal direction thereof for displacing the respective tool element between its resting position within the housing and an operative position in which it projects outwardly of the housing through the passage opening. Locking means are provided for rotatingly and longitudinally locking each tool element in the operative position. Each actuating means together with the respective tool element is movable beyond its operative position and is allowed to come in engagement with locking faces acting as said locking means by rotation about the longitudinal axis of the tool element and a reverse displacement in longitudinal direction.

7 Claims, 2 Drawing Sheets

TOOL HAVING SWITCHABLE PIN-SHAPED TOOL ELEMENTS

The invention relates to a tool having a plurality of switchable pin-shaped tool elements, comprising a substantially cylindrical housing having a cavity therein opening to the outside through a passage opening lying substantially on the axis of the housing, the cavity containing a plurality of tool elements spaced regularly around the circumference of the housing and lying outside the axis of the housing in their resting positions, the tool elements each comprising actuating means projecting outwardly of the housing and being movable in longitudinal direction thereof for displacing the respective tool element between its resting position within the housing and an operative position in which it projects outwardly of the housing through the passage opening, and locking means being provided for rotatingly and longitudinally locking each tool element in the operative position.

Such a tool, which is mostly intended as screw driver having switchable screw driver bits, is known from U.S. Pat. No. 3,750,729. There the locking means consist of a finger operated locking structure mounted on the front side of the handle, which forms the housing, and a locking nose of which may engage in a circumferential groove of the tool element. This locking structure not only makes the tool complex and hence expensive, but also adversely affects the handling and failure sensitivity.

U.S. Pat. Nos. 2,749,953; 2,765,013 and 3,194,286 and Dutch patent application 8103593 also show tools which are difficult to operate and/or have a structure too complex to be successful in practice.

The object of the present invention is to provide a tool of the type mentioned in the preamble, wherein said disadvantages are removed in an effective way.

For this purpose, the tool according to the invention is characterized in that each actuating means together with the respective tool element is movable beyond its operative position and is allowed to come in engagement with locking faces acting as said locking means by rotation about the longitudinal axis of the tool element and a reverse displacement in longitudinal direction.

Due to this manner of operation and locking of the tool elements it is possible to obtain both an effective lock and an easy operation, in particular with one hand, with simple means.

This may for example be enabled in that each actuating means is guided by a slot arranged in the side wall of the housing and being provided at the end facing the passage opening of the housing with a substantially circumferentially extending curve portion and a reversely extending locking portion.

A very favourable embodiment of the tool according to the invention is characterized in that the locking faces are formed within the passage opening and cooperate with counter faces formed on the tool elements.

This structure enables the tool to absorb the force, caused at the front end of the respective tool element, at a minimum distance thereby minimizing the bending and torsional loads on the tool element and locking means.

A simple realization of said locking and counter faces is possible if each tool element comprises at least one radially outwardly protruding projection having a first counter face and a substantially axially second counter face facing away from the front end of the tool element, said passage opening comprising two recesses complementary with the projection of the tool elements and angularly displaced in a circumferential direction about the passage opening, one of said recesses passing through and the other including said first locking faces and being closed by the substantially axial second locking face facing the front end of the housing, said locking face being able to cooperate with the axial counter face of each tool element, and each tool element being movable in longitudinal direction with its projection up to a point outwardly of the through-passing recesses in the passage opening.

It is then for instance conceivable that the projection of the tool element is formed by the corners of a portion of the tool element having a square cross section, while the passage opening is square and has additional recesses forming a square which is off-set 45° to the locking faces.

The invention will hereafter be elucidated with reference to the drawings showing an embodiment of the tool according to the invention schematically.

Figure 2:
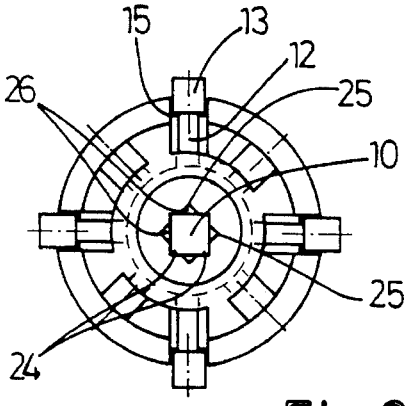
FIG. 2 is a front view of the tool of FIG. 1.

The drawings show a hand tool 1 comprising four switchable pin-shaped tool elements 2, which may consist of different types and sizes of screw driver bits, a piercer, a hand drill, a socket range, a dowel and the like. The tool 1 may of course also be equipped with another number of tool elements 2 than four. Further it is possible to make the tool suitable for attachment to a drill head of a drilling machine or to adapt the tool 1 so as to form a fixed head of a multifunctional machine. One may also think of a tool suited both for a drilling machine and for hand operation, for example because the rear side of the tool carries a means serving both for attachment to the drill head and for mounting to a handle.

The tool 1 has a substantially cylindrical housing 3 constructed as a handle having a thin front neck portion 4, a central main portion 5 of greater diameter, and a conical portion 6 connecting to the rear side of the main portion 5 and forming a transition to a thicker rear portion 7. The handle 3 is provided with an internal cavity 8 (FIG. 3, 4) extending in longitudinal direction of the handle and being closed at the rear end by a cover 9 and opening to the outside at the front end of the handle 3 through a passage opening 10 lying on the axis of the handle.

The cavity 8 is intended to receive the tool elements 2 such that the tool elements 2 are displaceable between a retracted resting position within the cavity 8 in the handle 3 and an extended operative position projecting outwardly through the passage opening 10. The tool elements 2 are arranged symmetrically along the circumference of the cavity 8 in the handle 3 and are provided with an actuating means 11 consisting of an arm 12 positioned radially on the tool element 2 and a knob 13 formed on the radially outward end thereof. The arm 12 of each tool element 2 projects through a slot 14 formed in the wall of the handle 3 and extending generally in longitudinal direction of the handle 3, the knob 13 protrudes outside the handle 3 and allows actuation by a finger for moving the respective tool element 2 between the resting and operative positions. The knob 13 is wider than the arm 12 in circumferential direction of the handle 3 and bears with the projecting portions on either side of the arm 12 on ridges 15 on either side of the slot 14. At the conical portion 6 of the handle 3, forming a transition between the thicker rear portion 7 and the main portion 5 of the handle 3, the ridge 15 also has a forwardly declining portion 16. By means of this declining portion 16, the knob 13 and consequently also the respective tool element 2, when it is slid forwardly from the resting position, is displaced radially inwardly such a distance that the respective tool element 2 coincides with the axis 17 of the handle and hence becomes aligned with the passage opening 10 for the tool elements 2. Upon a further forward displacement of the tool element 2 by means of the corresponding knob 13, the tool element 2 may hence be taken out through the passage opening 10. The tool elements 2 are arranged and configured such that the tool elements 2, which are in their resting position, guide the tool element 2 which is moved to the operative position (see FIG. 4).

Figure 1:
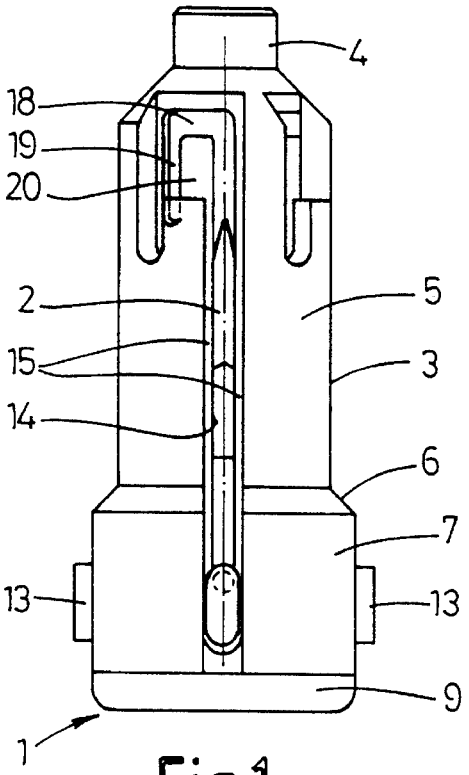
FIG. 1 is a side view of the exemplary embodiment of the tool according to the invention.

As shown particularly in FIG. 1, the slot 14 is provided on the front end of the handle 3 with a rounded curve portion 18 or portion extending in circumferential direction of the handle 3, and a locking portion 19 joining thereto and extending parallel to the main portion of the slot 14, said locking portion 19 having a substantially shorter length than the main portion of the slot 14. In the curve portion 18 of the slot 14, the knob 13 is radially supported by a support face 20 extending at the same radial depth as the ridge 15. The function of the slot portions 18 and 19 will be further explained later on with reference to FIGS. 5–8.

Figure 4:
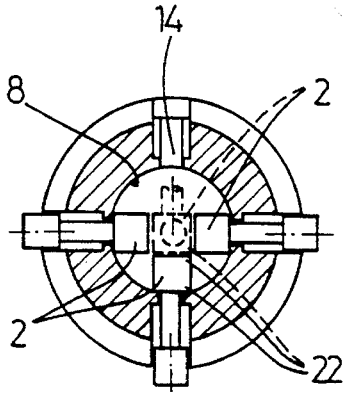
FIG. 4 is a section along the line IV—IV of FIG. 3.
Figure 3:
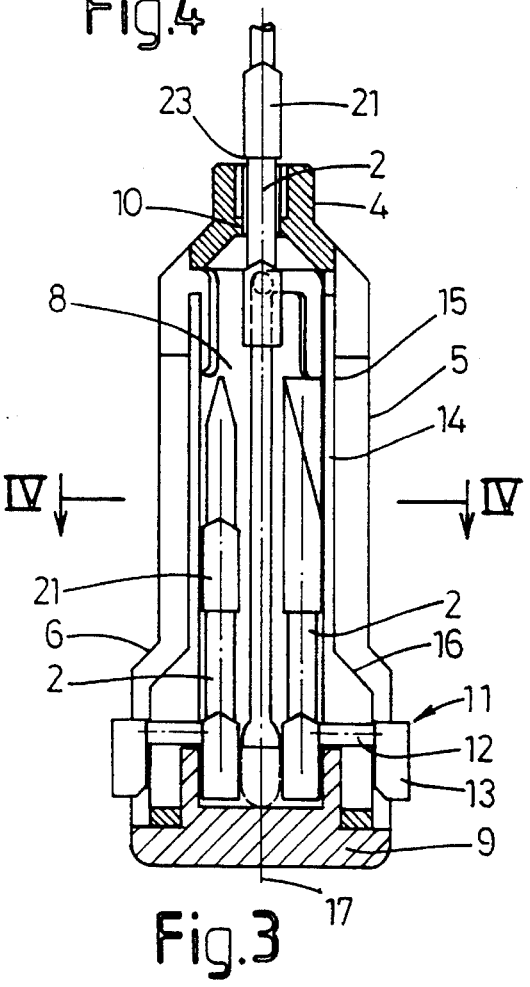
FIG. 3 is s longitudinal section of the tool of FIG. 1.

As shown in FIG. 3 and 4, each tool element 2 comprises a portion 21 having a square cross section, of which at least the corners 22 project radially outside the remaining portion of the tool element 2. The square portion 21 is limited on the rear side by an axial face 23. As shown in FIG. 2, the passage opening 10 is shaped such that along the whole length of the passage opening 10 there is arranged a formation which is complementary with that of the square portion 21 of each tool element 2 and as a result, the corners 22 of each tool element 2 engage in first recesses 24, and along a portion of the passage opening 10 adjacent the front end thereof, there are arranged second recesses 25 also complementary with the corners 22 of the square portion 21 of each tool element 2 and being angularly off-set 45° in circumferential direction of the passage opening 10 with respect to the first recesses 24. These second recesses 25 are limited on one side in longitudinal direction by axial faces 26. As will be made clear later on, the second recesses 25 and the axial faces 26 function as locking faces for the counter faces 22 and 23 of each tool element 2.

The operation of the tool shown is explained with reference to FIGS. 5–8.

Figure 5:
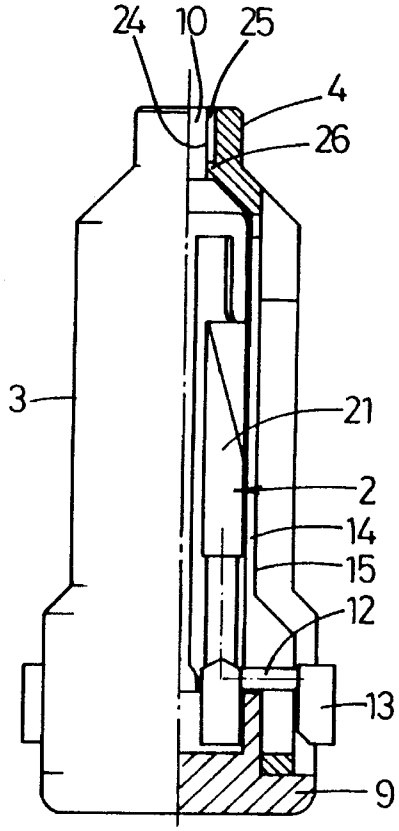

In FIG. 5, all tool elements 2 are received in their resting position within the handle 3 of the tool 1. In this resting position the tool elements are retained, for instance because the knob 13 thereof clamps slightly within the recess in the rear portion 7 of the handle, or because it is arrested by spring tensioned arresting balls. As a result, the tool elements 2 cannot be too easily slid from their resting position by accident.

Figure 6:
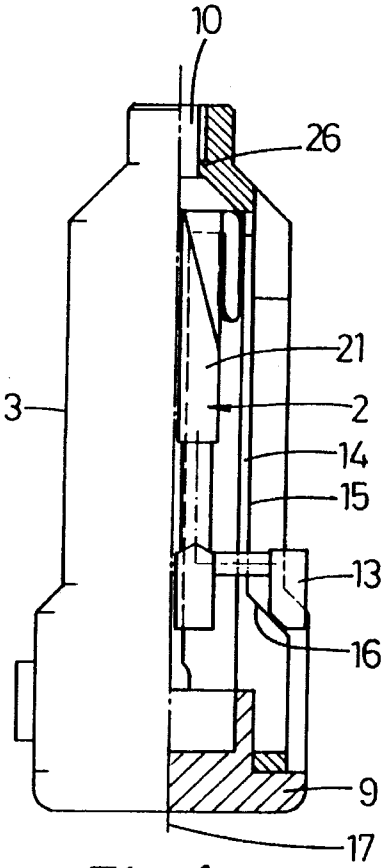

As shown in FIG. 6, one of the tool elements 2 may at any time be slid from the resting position forwardly in a direction to the operative position by exerting a forward pressure on the knob 13. Then the knob 13 of the actuating means 11 and consequently the respective tool element 2 first moves parallel to the axis 17 of the handle 3 and, upon arrival at the declining portion 16 of the ridge 15 to which the knob 13 rests, the knob 13 together with the tool element 2 are also moved radially inwardly such a distance that the tool element 2 comes to lie on the axis 17 of the handle 3 and hence in alignment with the passage opening 10 thereof.

Figure 7:
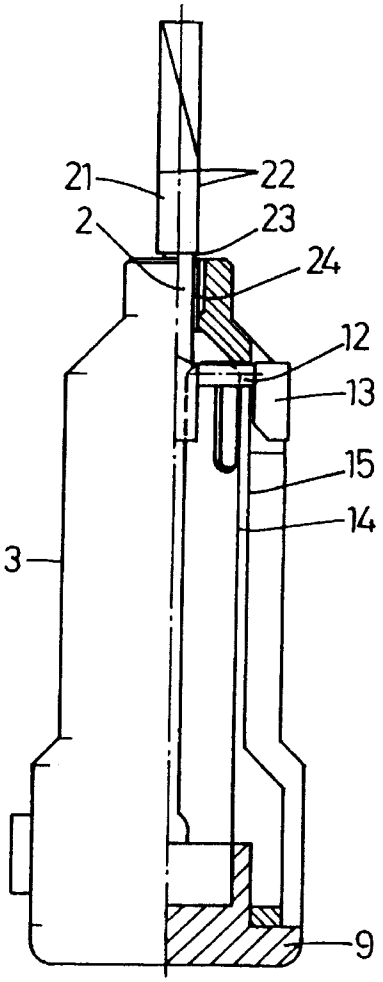

FIG. 7 shows the position of the tool element 2, in which it is moved maximally forwardly by means of the knob 13 and consequently the arm 12 on the knob 13 has arrived at the curve portion 18 of the slot 14. In this position, the square portion 21 of the tool element 2 has passed the passage opening 10. During the passage of the passage opening 10, the corners 22 of the square portion 21 were guided by the first recesses 24 of the passage opening. In the position of FIG. 7, a relatively thin cylindrical portion is in the passage opening 10 and is capable of being rotated within the passage opening.

This possibility of rotation of the tool element 2 in the position of FIG. 7 is used by turning the tool element 2 45° about its longitudinal axis by means of the knob 13. This is accomplished by pushing the knob 13 in circumferential direction of the handle 3 and permitting the arm 12 to pass the curve portion 18 of the slot during which displacement the tool element 2 is rotated. By the rotation of the tool element 2 along an angle of 45° the corners 22 of the square portion 21 thereof become aligned with the second recesses 25 of the passage opening 10 so that in this position the tool element 2 may be slid back again.

Figure 8:
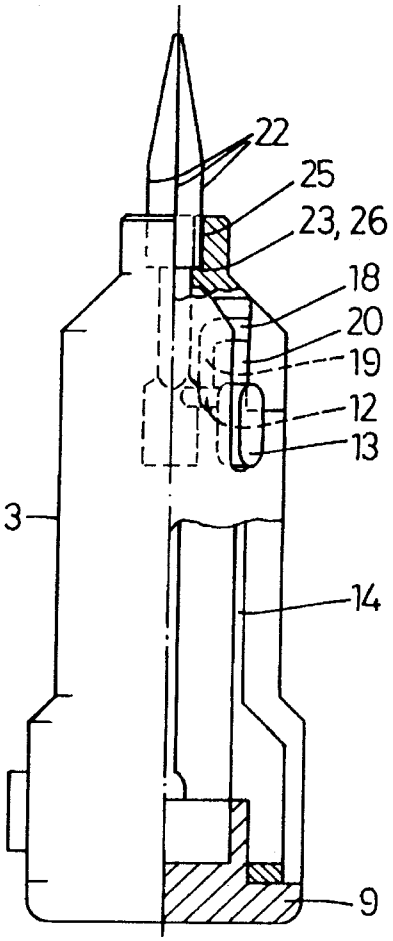
FIGS. 5–8 are generally half longitudinal sections of the tool of FIG. 1 illustrating the movement of one tool element between its resting position and its operative position.

In FIG. 8, the tool element 2 is shown in its locked operative position in which the arm 12 is moved within the locking portion 19 of the slot 14 by the knob 13 and the knob 13 has arrived in a position in which it is retained by a clamping action or a ball arresting device. In this position, the square portion 21 rests with its axial face 23 against the axial faces 26 of the second recesses 25 so that the tool element 2 is supported in longitudinal direction in a very stable manner. Furthermore, the tool element 2 is very tightly locked in circumferential direction because the locking faces of the second recesses 25 of the passage opening 10 counteract a rotation in cooperation with the counter faces on the square portion 21 of the tool element 2.

From this locked operative position the tool element can be moved in reverse sense back to its resting position, whereafter one of the other tool elements 2 may be actuated for use, for example.

From the foregoing it will be clear that there is provided a tool equipped with a plurality of switchable pin shaped tool elements, which is sturdy and requires only little number of moving parts on the one hand and which may simply be actuated with one hand on the other hand. The tool may be fully made of steel or another metal, but it is very well possible to make less loaded parts from plastic. The cylindrical neck portion 4 and the tool elements 2 are the heaviest loaded parts and should be strong.

The invention is not restricted to the embodiment shown in the drawing and described herein before which may be varied in different manners within the scope of the invention. The tool elements 2 may for instance be biassed to their resting position by means of springs so that a sufficient locking of the tool elements 2 both in the resting position and in the operative position is obtained. The locking faces of the handle and the counter faces of each tool element 2 may also be formed in another way. The locking may then also be effected by an engagement of the arm 12 and the slot 14. Further it is possible to provide the tool elements 2 with a changeable front portion forming the actual tool element, while the remainder serves as holder. In this way, the tool may be used with an infinite number of tool elements of which a number, for instance four, is directly available. The attachment of the front portion may be effected by inserting the front portion in a suitable recess but also by a screw attachment.

I claim:

1. A tool (1) having a plurality of switchable pin-shaped tool elements (2), comprising a substantially cylindrical housing (3) having a cavity (8) therein opening to the outside through a passage opening (10) lying substantially on an axis of the housing (3), the cavity (8) containing the plurality of tool elements (2) being disposed around the axis of the housing (3) in their resting positions, each tool element comprising an actuator (11) projecting outwardly of the housing (3) and being movable in longitudinal direction thereof for displacing the respective tool element (2) between its resting position within the housing (3) and an operative position in which it projects outwardly of the housing (3) through the passage opening (10), and locking means (18–26) being provided for rotating and longitudinally locking each tool element (2) in the operative position, wherein each actuator (11) together with the respective tool element (2) is movable beyond its operative position and is allowed to come in engagement with locking faces (25, 26) on the housing acting as said locking means by rotation about the longitudinal axis of the tool element (2) and a reverse displacement in longitudinal direction wherein the locking faces (25, 26) are formed within the passage opening (10) and wherein each tool element (2) comprises at least one radially outwardly protruding projection (22) having a first counter face and a substantially axially second counter face (23) facing away from a front end of the tool element (2), said passage opening (10) comprising two recesses (24, 25) complementary with the projection (22) of the tool elements (2) and displaced angularly in a circumferential direction about the passage opening (10), one (24) of said recesses passing through the other (25) including said locking faces and being closed by a substantially axial second locking face (26) facing the front end of the housing (3), said second locking face (26) being able to cooperate with the second counter face (23) of each tool element (2), and each tool element (2) being movable in longitudinal direction with its projection (22) up to a point outwardly of the through-passing recess (24) in the passage opening (10).

2. The tool of claim 1, wherein each actuator (11) is guided by a slot (14) arranged in the side wall of the housing (3) and being provided at the end facing the passage opening (10) of the housing (3) with a substantially circumferentially extending curve portion (18) and a reversely extending locking portion (19).

3. The tool of claim 1, wherein the tool elements (2) are retained in forward direction in their resting position and in their operative position by means of retaining means.

4. The tool of claim 1, wherein the tool elements (2) are positioned such within the cavity (8) of the housing (3) and are dimensioned such that the tool elements (2), which are in their resting position, form a longitudinal guide for the tool element (2) moved to and from the operative position.

5. The tool of claim 1, wherein each tool element (2) and respective actuator (11) form a rigid unit.

6. The tool of claim 1, wherein each actuator (11) comprises an arm (12) guided in a respective slot (14) of the housing (3) and having on its radially outward end a finger operated knob (13) guided along a ridge (15) on both sides of the slot (14).

7. A tool (1) having a plurality of switchable pin-shaped tool elements (2), comprising a substantially cylindrical housing (3) having a cavity (8) therein opening to the outside through a passage opening (10) lying substantially on an axis of the housing (3), the cavity (8) containing the plurality of tool elements (2) being disposed around the axis of the housing (3) in their resting positions, wherein each tool element comprises a rigid rod having at least one radially extending projection (22) with locking faces comprising a first counter face and a substantially axially second counter face (23) facing away from the front end of the tool element (2), the locking faces adapted to selectively engage corresponding locking faces formed within the passage Opening (10), and a knob (13) spaced-apart from the locking faces, the knob (13) projecting out of the housing (3) and being movable in a corresponding slot formed in the housing (3) having a main portion for displacing the respective tool element (2) between its resting position within the housing (3) and beyond an operative position in which a forward end of each tool projects outwardly of the housing (3) through the passage opening (10), a curved portion (18) for rotating each respective tool element (2) to align the locking faces of the tool element (2) with the locking faces within the passage opening (10), and a locking portion (19) to allow retraction of the tool element (2) into the housing (3) to the operative position, wherein said passage opening (10) comprises two recesses (24, 25) complementary with the projection (22) of the tool elements (2) and displaced angularly in a circumferential direction about the passage opening (10), one (24) of said recesses passing through the other (25) including said locking faces of the passage opening (10) and being closed by a substantially axial locking face (26) facing the front end of the housing (3), said axial locking face 126) being able to cooperate with the second counter face 123) of each tool element (2), and each tool element (2) being movable in longitudinal direction with its projection (22) up to a point outwardly of the through-passing recess (24) in the passage opening (10).

* * * * *

UNITED STATES PATENT AND TRADEMARK OFFICE

CERTIFICATE OF CORRECTION

PATENT NO. : 5,526,721

DATED : June 18, 1996

INVENTOR(S) : Eduard A. Waisvisz

It is certified that error appears in the above-indentified patent and that said Letters Patent is hereby corrected as shown below:

Column 6, line 23, replace "Opening" with --opening--.

Column 6, line 43, replace "126" with --26--.

Column 6, line 44, replace "123" with --23--.

Signed and Sealed this

Fourth Day of February, 1997

*Attest:*

*Attesting Officer*

BRUCE LEHMAN

*Commissioner of Patents and Trademarks*